US005771987A

United States Patent [19]

Marbach

[11] Patent Number: 5,771,987

[45] Date of Patent: Jun. 30, 1998

[54] WHEELED VEHICLE, SPECIFICALLY A SWIMMING-POOL CLEANING ROBOT, WITH AUTOMATIC CHANGE OF TRAVEL DIRECTION WHEN MEETING AN OBSTACLE

[75] Inventor: Gerard Marbach, Cernay, France

[73] Assignee: Sweepy International S.A., Balma, France

[21] Appl. No.: 664,828

[22] Filed: Jun. 17, 1996

[30] Foreign Application Priority Data

Jun. 19, 1995 [FR] France ..... 95 07297

[51] Int. Cl.[6] ..... B62D 11/00

[52] U.S. Cl. ..... 180/6.66

[58] Field of Search ..... 180/6.2, 6.48, 180/6.6, 6.66, 168; 15/1.7, 319

[56] References Cited

U.S. PATENT DOCUMENTS

| | | | |
|---|---|---|---|
| 3,551,930 | 1/1971 | Myers | 180/6.2 |
| 3,570,227 | 3/1971 | Bellinger | 180/6.2 |
| 3,979,788 | 9/1976 | Strausak . | |
| 4,655,724 | 4/1987 | Law | 180/6.66 |
| 5,083,629 | 1/1992 | Chang | 180/6.2 |
| 5,256,207 | 10/1993 | Sommer . | |
| 5,435,031 | 7/1995 | Minaamii . | |
| 5,454,129 | 10/1995 | Kell . | |
| 5,507,058 | 4/1996 | Minami et al. . | |
| 5,542,141 | 8/1996 | Albright . | |

FOREIGN PATENT DOCUMENTS

| | | |
|---|---|---|
| A-0465453 | 1/1992 | European Pat. Off. . |
| A-0558337 | 9/1993 | European Pat. Off. . |
| A-2041339 | 1/1971 | France . |
| WO-A-95/02103 | 1/1995 | WIPO . |

*Primary Examiner*—Stephen Avila

*Attorney, Agent, or Firm*—Dean W. Russell; Kilpatrick Stockton LLP

[57] ABSTRACT

Wheeled vehicle which automatically changes travel direction when it meets an obstacle and which includes two independent front driving wheels; two obstacle-detection units located on the front of the vehicle at each side; a transmission mechanism for each driving wheel from a motor shaft through a mechanism for reversing the direction of rotation; and a connection mechanism placed between each obstacle-detection unit and the transmission mechanism for each driving wheel located on the opposite side; the obstacle-detection units and connection mechanisms being arranged in such a manner that, when the vehicle meets an obstacle, the detection unit or units actuated by the obstacle act through the corresponding connection mechanisms so as to actuate the direction-reversing mechanism, and to have the rotation of the driving wheel pass from the forward direction to the rear direction.

14 Claims, 2 Drawing Sheets

WHEELED VEHICLE, SPECIFICALLY A SWIMMING-POOL CLEANING ROBOT, WITH AUTOMATIC CHANGE OF TRAVEL DIRECTION WHEN MEETING AN OBSTACLE

The present invention relates to the improvement of wheeled vehicles which automatically change travel direction when they meet an obstacle. This device is provided with two independent front drives and comprises:

- two obstacle-detection units located on the front of the vehicle at each side,
- means of transmission for each driving wheel from a motor shaft, through means for reversing the direction of rotation,
- means of connection placed between each obstacle-detection unit and means of transmission for the driving wheel located on the opposite side,
- said obstacle-detection units and said means of connection arranged in such a manner that, when the vehicle meets an obstacle, the means of detection actuated by said obstacle act, through said corresponding means of connection, so as to actuate said means for reversing the direction of rotation, and to have the rotation of the driving wheel pass from the forward direction to the rear direction.

Such vehicles are utilized, for example, to serve as cleaning robots for liquid tanks, such as swimming pools. Various applications of such swimming-pool cleaning robots are known although, by reason of their very design, they present the inconvenience of always being diverted in the same direction when they encounter an obstacle and also the inconvenience of always being diverted practically from the same angle. As a result, these vehicles can at times encounter difficulties in freeing themselves from certain obstacles, or even not getting free (for example, if they are caught between a ladder and the swimming pool wall; furthermore, their practically constant shifting before an obstacle sends them in particular directions such that their successive trajectories finish by being superimposed and the vehicles do not traverse the entire bottom surface of the pool. Hence, their function as a vehicle is not satisfactory and the swimming pool is not cleaned in a sufficiently efficient manner.

The essential object of the invention is to remedy the inconveniences inherent in known vehicles and to propose an improved vehicle which is capable of freeing itself in an unfailing fashion when facing any obstacle whatsoever and which, while freeing itself, is capable of pivoting from a non-predetermined angle such that its successive trajectories are perfectly unpredictable and that, since it is a matter of a cleaning robot for swimming pools, the cleaning is rendered efficient over the entire bottom surface of the pool, it being also understood that the technical means applied to these goals should be simple, feasible and of limited cost so that the vehicle improved in conformance with the invention can be mass-produced.

To these ends, a wheeled vehicle as mentioned in the preamble and equipped in conformity with the invention, essentially comprises obstacle-detection units each of which consists of an elongated unit constituted by the front edge, extending practically on a half-width and on the corresponding angle of the front of the vehicle which is opposite to the driving wheel with which said unit is operationally associated, an arm shaped in such manner that its opposite end is practically located in the area of the driving wheel that it controls and is supported at free rotation on a revolving axis practically vertical, and said extended unit is coupled in a selective manner to the motor shaft driving said driving wheel through the aforementioned connection means.

Because of this structure, the vehicle is made in a symmetrical fashion and is so equipped that its release is effected in a direction opposite to the obstacle. If the obstacle is perfectly frontal or bilateral, the two obstacle detectors are actuated simultaneously, and both driving wheels are simultaneously induced to turn in reverse direction such that in the first instance the vehicle goes backward without being diverted. In any case it succeeds in freeing itself irrespective of the position (lateral, frontal, bilateral), the nature (plane, concave) and the dimension (in particular the width) of the obstacle. The obstacle detection function is thus ensured in an efficient fashion, and an appropriate control can be ensured regardless of the position of the obstacle with respect to the front of the vehicle.

In a particular preferred type of application, the means for reversing the direction of rotation comprise a drive pinion located at the end of the motor shaft as well as a central gear and an annular gear which are integral with the driving wheel and with one or the other which can mesh with the drive pinion in order to determine respectively two directions of rotation of the driving wheel.

The means of connection can be provided with a pillow block supporting the drive shaft, and which is movable approximately transversely to said shaft when the obstacle detection means are actuated; in a preferred type of application, said means of connection also comprise a movable follower driven by said arm in such manner as to occupy two positions, namely:

- a first non-functional position occupied when the arm is in a rest position during the absence of an obstacle,
- a second functional position occupied when the arm is displaced by an obstacle, in which the follower works with a cam mounted on the drive shaft, in such manner as to push back the pillow block supporting said drive shaft and to modify the meshing of the drive pinion.

Furthermore, it is desirable that the means of connection also include means of temporary blocking capable of maintaining the reverse rotation of the driving wheel during a sufficient period so that the vehicle can free itself from the obstacle, then to re-establish the rotation of the driving wheel to its initial direction so that the vehicle starts out again on a new trajectory; advantageously the means of blocking include a catch fixed to the movable pillow block of the drive shaft which is engaged elastically when the block is displaced under the action of the cam.

Preferably, the means of temporary blocking are arranged so as to maintain the reverse rotation of the driving wheel during a non-predetermined period, hence the vehicle is induced to turn from a non-predetermined and unpredictable angle such that its successive trajectories are not superimposed and are unpredictable. It is interesting to note that, to obtain a simple yet feasible structure, the means of temporary blocking also include a transversal pin integral with the driving wheel and capable of working with the aforementioned catch when the latter is engaged, in order to release it and free the pillow block from the drive shaft, elastic return means being provided to return the block to its initial position.

The invention will be better understood when reading the following description of a preferred type of application given solely as an example and not at all restrictive. In this description reference is made to the annexed drawings on which:

Figure 1:
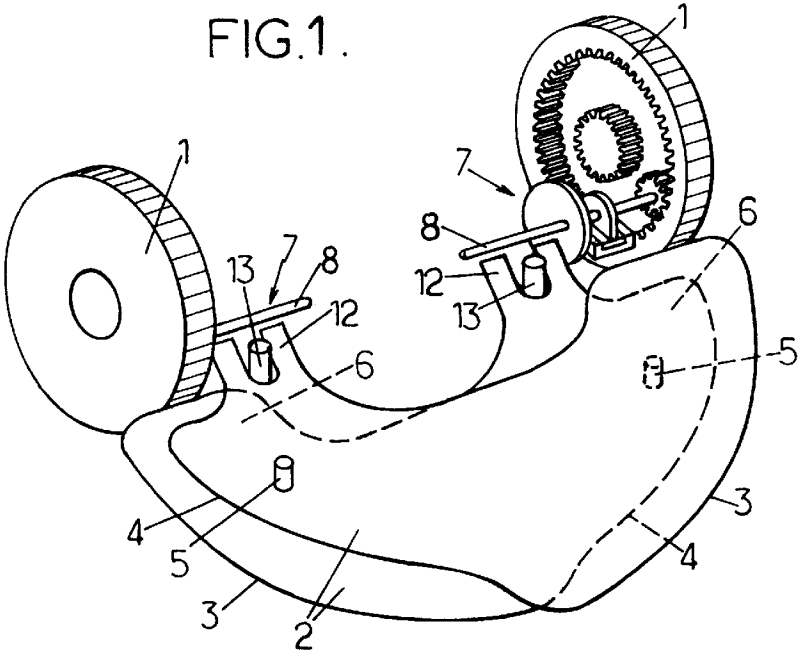
FIG. 1 is a comprehensive perspective view of a mechanism equipping a vehicle, such as a swimming-pool cleaning robot, arranged in conformance with the invention.

In FIGS. 1 through 4, and particularly in FIG. 1, only the portion of the wheeled vehicle involved in the invention is shown. The remainder of the vehicle can be arranged in any manner depending upon applications and needs. In particular, the number of wheels, the type of motorization (electric, hydraulic, mechanical, . . . ) as well as the work equipment and the general shape (body, dimensions, . . . ) can be anything provided that it does not affect the main mechanism which now is going to be more particularly taken into account.

In addition, although the arrangements peculiar to the invention have been more particularly developed with the goal of producing an improved swimming-pool cleaning robot, it is obvious that said arrangements can find applications for equipping any type of wheeled vehicle which automatically changes direction in the presence of an obstacle. The same arrangements could also be applied in a floating vehicle driven by two propulsion units spread apart transversely.

FIG. 1 shows two front wheels 1 of a vehicle which are driven independently (i.e., not fixed onto a common shaft) yet capable of being driven by a common motor (not shown).

At the front of the vehicle there are two obstacle-detection units which are arranged to detect obstacles respectively on both sides of the middle of the front. Furthermore, each obstacle-detection unit is arranged to be functional not only on a frontal half of the vehicle but also in the corresponding lateral angle, or even on the front end of the corresponding side.

Lastly, each obstacle-detection unit is associated with means of connection arranged in such manner that when the detection unit hits an obstacle it controls the reversing of the direction of rotation of the opposite driving wheel and thus initiates the pivoting of the vehicle to the opposite of the obstacle.

Figure 2:
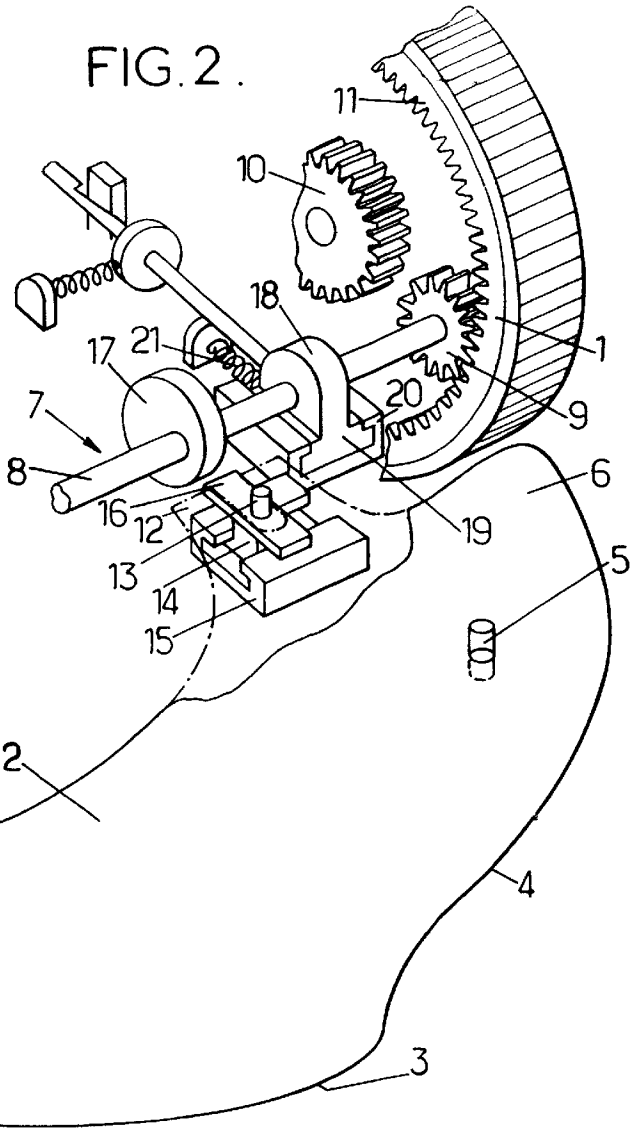
FIG. 2 is an enlarged more detailed view of one-half of the mechanism of FIG. 1.

As can be seen in FIGS. 1 and 2, each obstacle-detection unit consists of an elongated unit or arm 2 in the general shape of a mustache or a crescent moon which extends approximately across the front end of the vehicle. Each detector 2 has an active edge 3 projecting toward the front and extending on a frontal half of the vehicle as well as into the angle and on the beginning of the corresponding side of the vehicle. On the other frontal half of the vehicle, edge 4 of the detector is set back toward the rear.

The two detectors 2 are arranged one above the other, while being inverted one with respect to the other in such manner that set-back edge 4 of one coincides with projecting active edge 3 of the other.

Each detector 2 is supported in free rotation on a practically vertical axis 5 by its end 6 located on the side of set back edge 4. Lights can possibly be provided in the other detector to allow their respective free rotating movements.

This same end 6 of detector 2 is associated with the means of connection, designated overall by reference 7, in such manner as to functionally control the rotating direction of driving wheel 1 which is located on this same side. In other words, when an obstacle acts on edge 3 of detector 2, this detector 2 controls wheel 1 located on the opposite side.

The engagement and the reversing of the rotating direction of each driving wheel 1 are arranged as follows. Motor shaft 8 (driven by a central motor, not shown) is equipped at its free end with driving pinion 9. Wheel 1 or the axle of wheel 1 are coaxially integrated with central gear 10 and annular gear 11 having teeth in the rim. Driving pinion 9 is located between central gear 10 and annular gear 11 and can mesh selectively with one or the other, as indicated hereinbelow.

The aforementioned means of connection are arranged as follows: A portion of end 6 of each detector 2 is fork shaped 12 co-acting with lug 13 integral with carriage 14 which is movable on a portion of fixed frame 15 following a direction approximately parallel to motor shaft 8.

Carriage 14 carries follower 16 which extends in the direction of shaft 8.

Approximately facing follower 16, cam 17 rotates on shaft 8.

Elsewhere, shaft 8 is supported by pillow block 18 which itself is supported by carriage 19 capable of sliding on fixed frame 20 following a direction approximately transversal to shaft 8.

In the absence of an obstacle, detector 2 is not deviated and it keeps follower 16 shifted laterally with respect to cam 17. Return spring 21 then keeps carriage 19 in a position at which pillow block 18 supports shaft 8 in rest position, driving pinion 9 meshing with annular gear 11. The corresponding rotation direction of driving wheel 1 is assumed to correspond to the forward travel of the vehicle.

When there is an obstacle which thrusts active edge 3 of detector 2 toward the rear, detector 2, in pivoting, initiates, by the skew of its fork 12, the displacement of follower 16 which is brought opposite cam 17. In turning, the latter bears against the follower and shaft 8 is pushed so that driving pinion 9 leaves annular gear 11 and goes to work with central gear 10. The latter is engaged in a direction opposite to annular gear 11 and driving wheel 1 turns in opposite direction.

Figure 3:
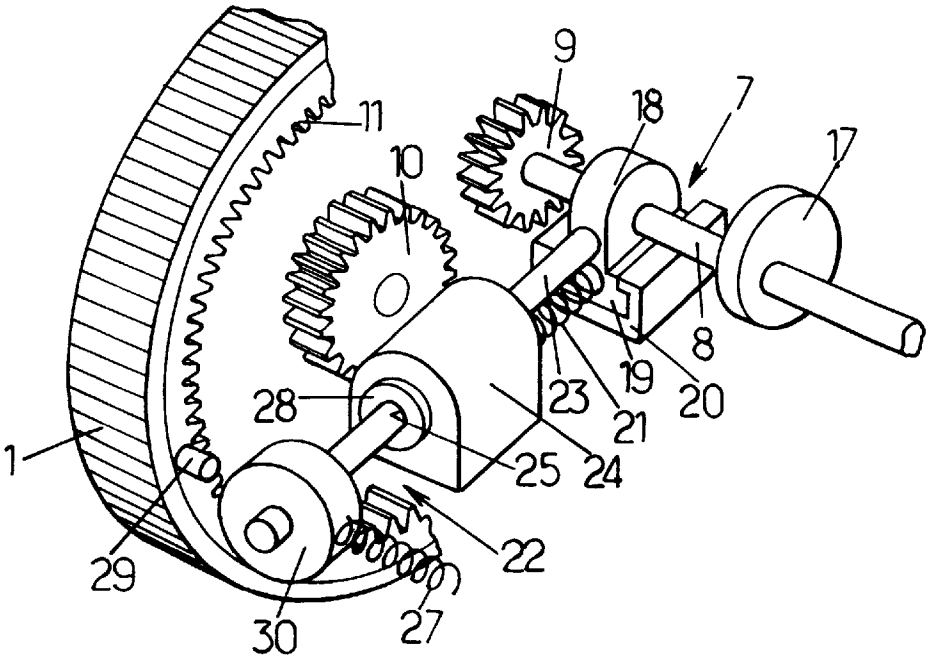
FIG. 3 is a greatly enlarged perspective view, from another angle, of another portion of the mechanism of FIG. 2.
Figure 4:
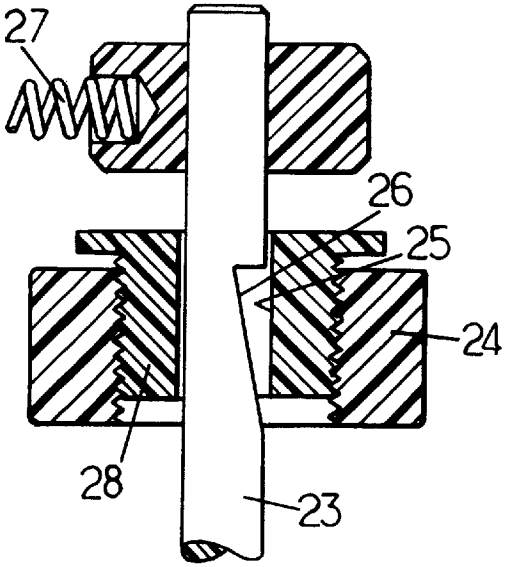
FIG. 4 is a fragmentary section of the mechanism of FIG. 3.

To provide sufficient time while pinion 9 works with central gear 10 enabling the vehicle to free itself, means of releasable blocking are provided and are designated by reference 22 in FIGS. 3 and 4.

The means of releasable blocking 22 comprise rod 23 sliding freely axially in passage 25 of fixed body 24 in a location facing pillow block 18 said rod 23 being fixed to said block 18. Rod 23 has radial notch 26 which, when it is disengaged outside of body 24, is thrust in bearing against the edge of passage opening 25 with the help of transversal spring 27 (rod 23 having a certain radial play in passage 25). It is possible to provide passage 25 in bushing 28 screwed into body 24 so as to permit travel adjustment, as shown in FIG. 4.

Releasing the means of blocking is accomplished as follows: Driving wheel 1 carries pin 29 which extends transversely and which, during the rotation of wheel 1, finds a component on its trajectory, for example ring 30, fixed to rod 23. Here, it will be noted that notch 26 is cut into rod 23 on the same side as pin 29. When pin 29 meets ring 30, it pushes it and, notch 26 being thus released, spring 21 returns all of the mobile gear train to the initial position again with meshing of pinion 9 with annular gear 11; driving wheel 1 then recovers forward rotation.

The arrangement which has just been described has an advantage in that, at the time of meeting an obstacle, pin 29 is in a random angular position with respect to ring 30. Driving wheel 1 therefore effects a rotation of non-predetermined, unpredictable angular amplitude before being again induced to rotate in a forward direction. After having hit an obstacle the vehicle is hence going to release itself by pivoting oppositely from the obstacle with an unpredictable angular amplitude and is going to start out again in forward direction on a new trajectory which is arranged in a random manner with respect to the preceding.

In the case where both detectors 2 are actuated simultaneously (meeting a central frontal obstacle), both driving wheels 1 are induced to turn in reverse direction in simultaneous fashion and the vehicle runs backward in practically a straight line. However, both pins 29 are not located, in principle, in the same relative angular position with regard to the two respective rings 30: one of the two pins 29 will hence meet its associated ring 30 before the other, and then the vehicle will be induced to turn in the direction determined by said first pin meeting its associated ring, then will start out again on a new trajectory as the previously described case. Here, however, both the straight line back-up distance and the side toward which the rotation will be effected as well as the angular amplitude of this rotation, are unpredictable: the new forward trajectory is, here again, sure of being arranged randomly with respect to the preceding.

Thus it is certain that the vehicle is not going to successively travel over the same itineraries and, in the particular case of a swimming-pool cleaning robot, it is certain that, by the combination of all of the successive unpredictable trajectories, the robot will travel over the totality of the swimming-pool bottom.

As it is evident and as a result moreover of the foregoing, the invention is not at all limited to those types of application and production which have been more particularly envisioned; on the contrary it encompasses all of the variations.

I claim:

1. Wheeled vehicle which automatically changes travel direction when it meets an obstacle, this device being provided with two independent front-wheel drives and comprising:

two obstacle-detection units located on the front of the vehicle at each side, means of transmission for each driving wheel from a motor shaft, through means for reversing the direction of rotation, means of connection placed between each obstacle-detection unit and means of transmission for the driving wheel located on the opposite side, said obstacle-detection units and said means of connection arranged in such a manner that, when the vehicle meets an obstacle, the means of detection actuated by said obstacle act, through said corresponding means of connection, so as to actuate said means for reversing the direction of rotation, and to have the rotation of the driving wheel pass from the forward direction to the rear direction, each obstacle-detection unit comprising an elongated unit constituted by the front edge, extending practically on a half-width and on the corresponding angle of the front of the vehicle which is opposite to the driving wheel with which said unit is functionally associated, an arm shaped in such manner that its opposite end is practically located in the area of the driving wheel that it controls and is supported at free rotation on a revolving axle practically vertical, and said extended unit is coupled in a selective manner to the motor shaft driving said driving wheel through the aforementioned connection means.

2. Vehicle as in claim 1 in which the means for reversing the direction of rotation comprise a drive pinion located at the end of the motor shaft, as well as a central gear and an annular gear which are integral with the driving wheel and with one or the other which can mesh with the drive pinion in order to determine respectively two directions of rotation of the driving wheel (1).

3. Vehicle as in claim 1 or 2 in which the means of connection comprise a pillow block supporting the drive shaft which is movable approximately transversely to said shaft when the obstacle detection means are actuated.

4. Vehicle as in claim 3 in which the means of connection comprise a movable follower driven by said arm in such manner as to occupy two positions, namely:

a first non-functional position occupied when the arm is in a rest position during the absence of an obstacle, a second functional position occupied when the arm is displaced by an obstacle, in which the follower works with a cam mounted on the drive shaft, in such manner as to push back the pillow block supporting said drive shaft and to modify the meshing of the drive pinion.

5. Vehicle as in claim 4 in which the means of connection also comprise means of temporary blocking capable of maintaining the reverse rotation of the driving wheel during a sufficient period so that the vehicle can free itself from the obstacle, then to re-establish the rotation of the driving wheel to its initial direction so that the vehicle starts out again on a new trajectory.

6. Vehicle as in claim 5 in which the means of blocking comprise a blocking catch fixed to the movable pillow block of the drive shaft which is engaged elastically when the block is displaced under the action of the cam.

7. Vehicle as in claim 5 or 6 in which the means of temporary blocking are arranged so as to maintain the reverse rotation of the driving wheel during a non-predetermined period, hence inducing the vehicle to turn from a non-predetermined and unpredictable angle such that its successive trajectories are not superimposed and are unpredictable.

8. Vehicle as in claim 7 in which the means of temporary blocking also comprise a transversal pin integral with the driving wheel and capable of working with the aforementioned catch when the latter is engaged, in order to release it and free the pillow block from the drive shaft, elastic return means being provided to return the block to its initial position.

9. A swimming pool cleaner comprising:

a. first and second wheels, each adapted to rotate;

b. means for driving the first and second wheels;

c. means for reversing the direction of rotation of the second wheel;

d. an obstacle-detection unit having (i) a recess and (ii) an edge for detecting an obstacle; and e. means, comprising a lug received by the recess, for coupling the obstacle-detection unit to the means for reversing the direction of rotation of the second wheel.

10. A swimming pool cleaner according to claim 9 further comprising:

a. means for reversing the direction of rotation of the first wheel; and b. a second obstacle-detection unit coupled to the means for reversing the direction of rotation of the first wheel and having an edge for detecting obstacles.

11. A swimming pool cleaner having a body defining a leading edge and an imaginary longitudinal centerline bisecting its width, comprising:

a. first and second wheels, each adapted to rotate;

b. means for driving the first and second wheels;

c. means for reversing the direction of rotation of the first wheel;

d. means for reversing the direction of rotation of the second wheel independent of the first wheel;

e. a first obstacle-detection unit coupled to the means for reversing the direction of rotation of the second wheel and having an edge for detecting an obstacle; and f. a second obstacle-detection unit coupled to the means for reversing the direction of rotation of the first wheel and having an edge for detecting an obstacle, which edge projects farther beyond the leading edge of the body than the edge of the first obstacle-detection unit on one side of the longitudinal centerline but projects less far beyond the leading edge of the body than the edge of the first obstacle-detection unit on the other side of the longitudinal centerline.

12. A swimming pool cleaner according to claim 11 in which the first and second wheels are the front wheels of the cleaner.

13. A swimming pool cleaner comprising:

a. first and second wheels, each adapted to rotate;

b. means for driving the first and second wheels;

c. means for reversing the direction of rotation of the first wheel;

d. means for reversing the direction of rotation of the second wheel independent of the first wheel;

e. a first obstacle-detection unit coupled to the means for reversing the direction of rotation of the second wheel and having an edge for detecting an obstacle; and f. a substantially vertical axle supporting the first obstacle-detection unit in free rotation.

14. A swimming pool cleaner according to claim 13 in which the first and second wheels are the front wheels of the cleaner.

* * * * *